US010388297B2

(12) United States Patent
Di Censo et al.

(10) Patent No.: US 10,388,297 B2
(45) Date of Patent: Aug. 20, 2019

(54) TECHNIQUES FOR GENERATING MULTIPLE LISTENING ENVIRONMENTS VIA AUDITORY DEVICES

(71) Applicant: HARMAN INTERNATIONAL INDUSTRIES, INC., Stamford, CT (US)

(72) Inventors: Davide Di Censo, San Mateo, CA (US); Stefan Marti, Oakland, CA (US); Ajay Juneja, Mountain View, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 14/483,044

(22) Filed: Sep. 10, 2014

(65) Prior Publication Data

US 2016/0071525 A1 Mar. 10, 2016

(51) Int. Cl.

| | |
|---|---|
| ***G10L 21/00*** | (2013.01) |
| ***G10L 21/0208*** | (2013.01) |
| ***H04S 7/00*** | (2006.01) |
| ***G10L 21/0272*** | (2013.01) |
| ***H04R 1/10*** | (2006.01) |

(52) U.S. Cl.

CPC ..... *G10L 21/0208* (2013.01); *G10L 21/0272* (2013.01); *H04R 1/1083* (2013.01); *H04S 7/30* (2013.01); *G10L 2021/02087* (2013.01)

(58) Field of Classification Search

CPC ..... G10L 21/00; G10L 21/003; G10L 21/02; G10L 21/0208; G10L 21/0264; G10L 21/0272; G10L 21/028

USPC ..... 704/226, 200, 200.1, 225, 227

See application file for complete search history.

(56) References Cited

U.S. PATENT DOCUMENTS

| | | | | |
|---|---|---|---|---|
| 5,815,582 | A | 9/1998 | Claybaugh et al. | |
| 7,940,705 | B2 * | 5/2011 | Shaffer ..... | H04M 3/5166 370/260 |

(Continued)

FOREIGN PATENT DOCUMENTS

| | | |
|---|---|---|
| EP | 2579676 A1 | 4/2013 |
| GB | 2 313 251 A | 11/1997 |

(Continued)

OTHER PUBLICATIONS

International Search Report for PCT/US2015/041843, dated Sep. 25, 2015.

(Continued)

*Primary Examiner* — Qi Han

(74) *Attorney, Agent, or Firm* — Artegis Law Group, LLP

(57) ABSTRACT

Approaches are disclosed for generating auditory scenes. A computing device includes a wireless network interface and a processor. The processor is configured to receive, via a microphone, a first auditory signal that includes a first plurality of voice components. The processor is further configured to receive a request to at least partially suppress a first voice component included in the first plurality of voice components. The processor is further configured to generate a second auditory signal that includes the first plurality of voice components with the first voice component at least partially suppressed. The processor is further configured to transmit the second auditory signal to a speaker for output.

19 Claims, 12 Drawing Sheets

(56) References Cited

U.S. PATENT DOCUMENTS

| | | | | |
|---|---|---|---|---|
| 8,605,863 | B1 * | 12/2013 | Sauriol | H04L 65/4015 379/32.01 |
| 8,749,610 | B1 * | 6/2014 | Gossweiler | H04N 7/15 348/14.08 |
| 2004/0121791 | A1 | 6/2004 | May et al. | |
| 2005/0060142 | A1 | 3/2005 | Visser et al. | |
| 2005/0213731 | A1 * | 9/2005 | Rodman | H04L 12/66 379/202.01 |
| 2006/0046761 | A1 | 3/2006 | Bishop et al. | |
| 2008/0075293 | A1 | 3/2008 | Sato | |
| 2009/0216835 | A1 * | 8/2009 | Jain | G06Q 10/10 709/204 |
| 2010/0073457 | A1 * | 3/2010 | Xu | H04L 12/1822 348/14.09 |
| 2012/0027217 | A1 | 2/2012 | Jun et al. | |
| 2012/0289277 | A1 * | 11/2012 | Ahmed | H04W 76/005 455/518 |
| 2015/0146878 | A1 * | 5/2015 | Meredith | G10K 11/178 381/71.6 |

FOREIGN PATENT DOCUMENTS

| | | | |
|---|---|---|---|
| JP | 2004-015090 | A | 1/2004 |
| JP | 2008-507926 | A | 3/2008 |
| JP | 2012-080514 | A | 4/2012 |
| WO | 2006/028587 | A2 | 3/2006 |

OTHER PUBLICATIONS

Extended European Search Report for Application No. 15840250.3 dated Feb. 16, 2018, 5 pages.

* cited by examiner

TECHNIQUES FOR GENERATING MULTIPLE LISTENING ENVIRONMENTS VIA AUDITORY DEVICES

BACKGROUND

Field of the Embodiments of the Invention

Embodiments of the present invention relate generally to human-device interfaces and, more specifically, to techniques for generating multiple listening environments via auditory devices.

Description of the Related Art

In various situations, people often find a need or desire to engage in a private conversation while in the presence of one or more other people. For example, and without limitation, a person participating in a conference meeting could receive an important phone call during the meeting. In order to prevent disruption of the meeting, the person could choose to physically leave the room or not take the call. In another example, and without limitation, a person riding in a vehicle could desire to initiate a telephone call while maintaining privacy with respect to other passengers or to avoid disrupting conversation among the other passengers. In such a case, the person could initiate the call and speak in a hushed voice or defer the call until a later time when the call could be made in private. In yet another example, and without limitation, the main conversation in a group meeting could give rise to a need for a sidebar meeting among a subset of the group meeting participants. In such a case, the subset of participants could adjourn to another meeting room, if another meeting room is available, or could defer the sidebar meeting until later.

One potential problem with these approaches is that an important or necessary conversation may be detrimentally deferred until a later time, or the main conversation may be disrupted by the second conversation. Another potential problem with these approaches is that the second conversation may not enjoy the desired level of privacy or may be conducted in whispers, making the conversation difficult to understand by the participants.

As the foregoing illustrates, a new technique to accommodate multiple conversations simultaneously would be useful.

SUMMARY

One or more embodiments set forth include a computing device that includes a wireless network interface and a processor. The processor is configured to receive, via a microphone, a first auditory signal that includes a first plurality of voice components. The processor is further configured to receive a request to at least partially suppress a first voice component included in the first plurality of voice components. The processor is further configured to generate a second auditory signal that includes the first plurality of voice components with the first voice component at least partially suppressed. The processor is further configured to transmit the second auditory signal to a speaker for output.

Other embodiments include, without limitation, a computer-readable medium that includes instructions that enable a processing unit to implement one or more aspects of the disclosed methods. Other embodiments include, without limitation, a method to implement one or more aspects of the disclosed methods as well as a computing system configured to implement one or more aspects of the disclosed methods.

At least one advantage of the approach described herein is that participants in a group may engage in multiple conversations while maintaining appropriate privacy for each conversation and reducing or eliminating disruption to other conversations. As a result, important conversations are not deferred and multiple conversations are accommodated without the need to find separate physical space to accommodate each separate conversation.

BRIEF DESCRIPTION OF THE SEVERAL VIEWS OF THE DRAWINGS

So that the manner in which the recited features of the one more embodiments set forth above can be understood in detail, a more particular description of the one or more embodiments, briefly summarized above, may be had by reference to certain specific embodiments, some of which are illustrated in the appended drawings. It is to be noted, however, that the appended drawings illustrate only typical embodiments and are therefore not to be considered limiting of its scope in any manner, for the scope of the invention subsumes other embodiments as well.

DETAILED DESCRIPTION

In the following description, numerous specific details are set forth to provide a more thorough understanding of certain specific embodiments. However, it will be apparent to one of skill in the art that other embodiments may be practiced without one or more of these specific details or with additional specific details.

System Overview

Figure 1:
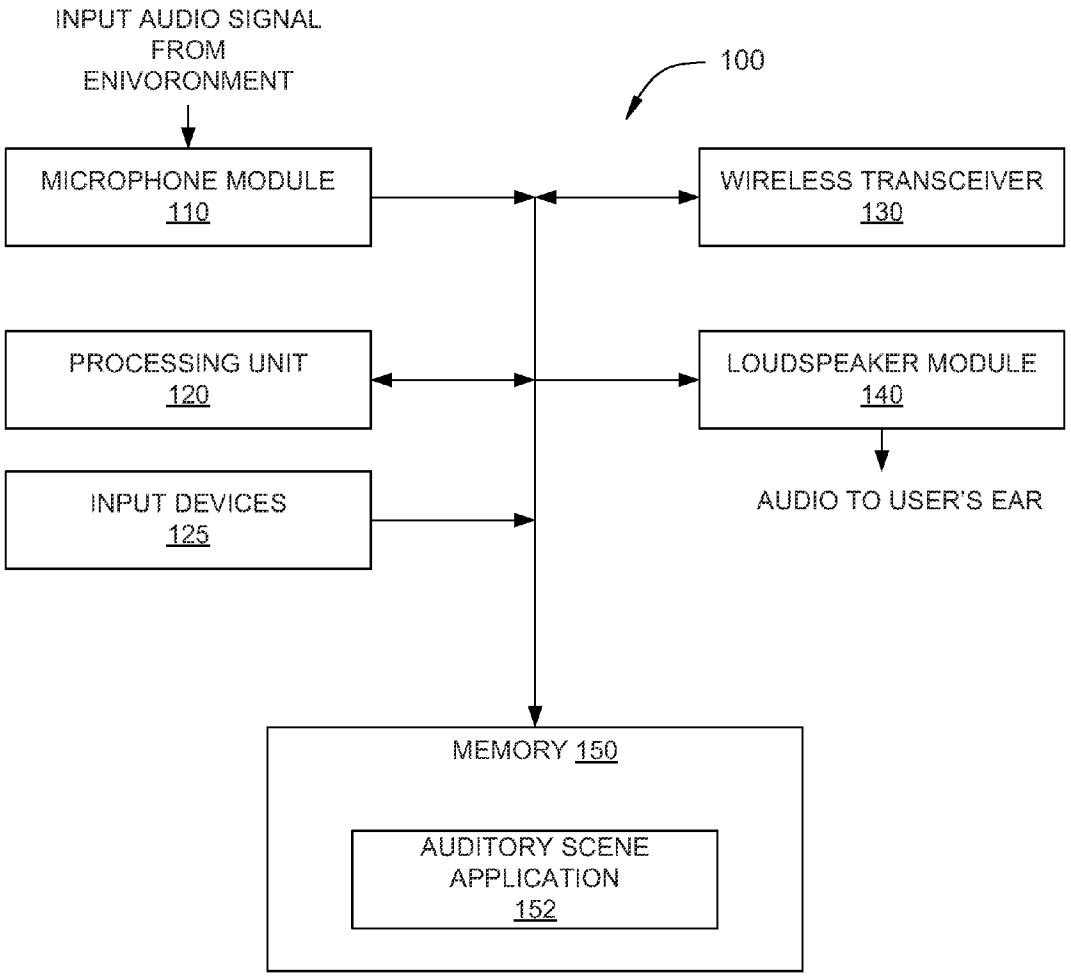
FIG. 1 illustrates an auditory scene controller operable to generate one or more auditory scenes, according to various embodiments.

FIG. 1 illustrates an auditory scene controller operable to generate one or more auditory scenes, according to various embodiments. As shown, auditory scene controller 100 includes, without limitation, a microphone module 110, processing unit 120, a wireless transceiver 130, a speaker module 140, and a memory unit 150, coupled together. Memory unit 150 includes an auditory scene application 152 which is a software application for generating various auditory scene configurations as further described herein. Auditory scene controller 100 may be embodied within any technically feasible computing device.

Microphone module 110 may be any technically feasible type of device configured to receive audio signals via a microphone and transducer the audio signals into machine readable form. Microphone module 110 is configured to receive audio signals from the physical environment and transduce those audio signals for further processing by processing unit 120 for processing, as described in greater detail below. The audio signals may include spoken voices from various participants in a meeting or other physical space as well as environmental audio sources such as background noise, music, street sounds, etc.

Processing unit 120 may be any technically feasible unit configured to process data and execute software applications, including, for example, and without limitation, a central processing unit (CPU), digital signal processor (DSP), or an application-specific integrated circuit (ASIC). Input devices 125 may include, for example, and without limitation, devices configured to receive input (such as, one or more buttons, without limitation). Certain functions or features related to an application executed by processing unit 120 may be accessed by actuating an input device 125, such as by pressing a button. As further described herein, processing unit 120 is operable to generate one or more audio groups or conversation "bubbles" to fully or partially isolate various users from each other.

Speaker module 140 may be any technically feasible type of device configured to receive audio signal, and generate a corresponding signal capable of driving one or more loudspeakers or speaker devices. The audio signal may be the audio input signal received by microphone module 110, or may be an audio signal generated by processing unit 120. The audio signal received from processing unit 120 may be an alternative version of the audio input signal received by microphone unit 110, but with one or more voices suppressed.

Wireless transceiver 130 may be any technically feasible device configured to establish wireless communication links with other wireless devices, including, without limitation, a WiFi™ transceiver, a Bluetooth transceiver, an RF transceiver, and so forth. Wireless transceiver 130 is configured to establish wireless links with other auditory scene controllers and a central communications controller, as further described herein.

Memory unit 150 may be any technically feasible unit configured to store data and program code, including, for example, and without limitation, a random access memory (RAM) module or a hard disk, without limitation. Auditory scene application 152 within memory unit 150 may be executed by processing unit 120 in order to generate one or more listening environments, also referred to herein as auditory scenes. An auditory scene represents a listening environment within which at least one voice component corresponding to a particular person is suppressed from being heard either by individuals inside the auditory scene or by people outside of the auditory scene. In one example, and without limitation, an auditory scene that includes one person could be generated such that no one else hears the person's voice. In another example, and without limitation, an auditory scene that includes one person could be generated such that the person does not hear anyone else's voice. In another example, and without limitation, an auditory scene that includes one person could be generated such that no one else hears the person's voice, and, simultaneously, the person simultaneously does not hear anyone else's voice. In yet another example, any number of auditory scenes may be generated, where each auditory scene includes any number of people, and each auditory scene suppresses various voices are prevented leaving or entering each auditory scene. In this manner, auditory scenes are very customizable and configurable. Accordingly, the auditory scenes described herein are merely exemplary and do not limit the scope of possible auditory scenes that may be generated, within the scope of this disclosure.

When generating auditory scenes, software application 152 may implement a wide variety of different audio processing algorithms to analyze and parse frequency and amplitude data associated with an audio input signal. Such algorithms are operable to suppress one or more voices from the input audio signal by one or more techniques.

In one example, and without limitation, processing unit 120 executing an auditory scene application 152 could determine a portion of the audio input signal corresponding to the one or more voices to be suppressed, generate an inversion audio signal representing the inverse signal corresponding to the one or more voices, and mix the inversion signal with the original audio input signal. In another example, and without limitation, processing unit 120 executing auditory scene application 152 could digitally receive a signal from the auditory scene controller of another user, where the received signal represents the original or inverted voice of the associated user as captured, for example, and without limitation, by the corresponding microphone module. Processing unit 120 would then invert the received signal, as appropriate, and mix the received signal with the audio input signal from microphone module 110. In yet another example, and without limitation, processing unit 120 executing an auditory scene application 152 could receive timing information from the auditory scene controller of another user, identifying when the associated user is speaking or is silent. Processing unit 120 processes the received timing information to determine time intervals during which processing unit 120 suppresses the audio input signal from microphone module 110. Auditory scene application 152 is configured to then transmit the processed audio signal to speaker module 140.

Persons skilled in the art will understand that the specific implementation of auditory scene controller 100 shown in FIG. 1, are provided for exemplary purposes only, and not meant to limit the scope of the present invention. In practice, auditory scene controller 100 may be implemented by a wide variety of different combinations of hardware and software. For example, and without limitation, auditory scene controller 100 could be implemented by an integrated circuit configured to perform the functionality described above, without limitation. In another example, and without limitation, auditory scene controller 100 could be implemented by a system-on-chip configured to perform that functionality, without limitation. As a general matter, any device configured to perform the functionality of auditory scene controller 100 described herein falls within the scope of the present invention. Similarly, auditory scene controller 100 may be configured to perform any technically feasible approach for removing one or more voices from an input audio signal.

Figure 2A:
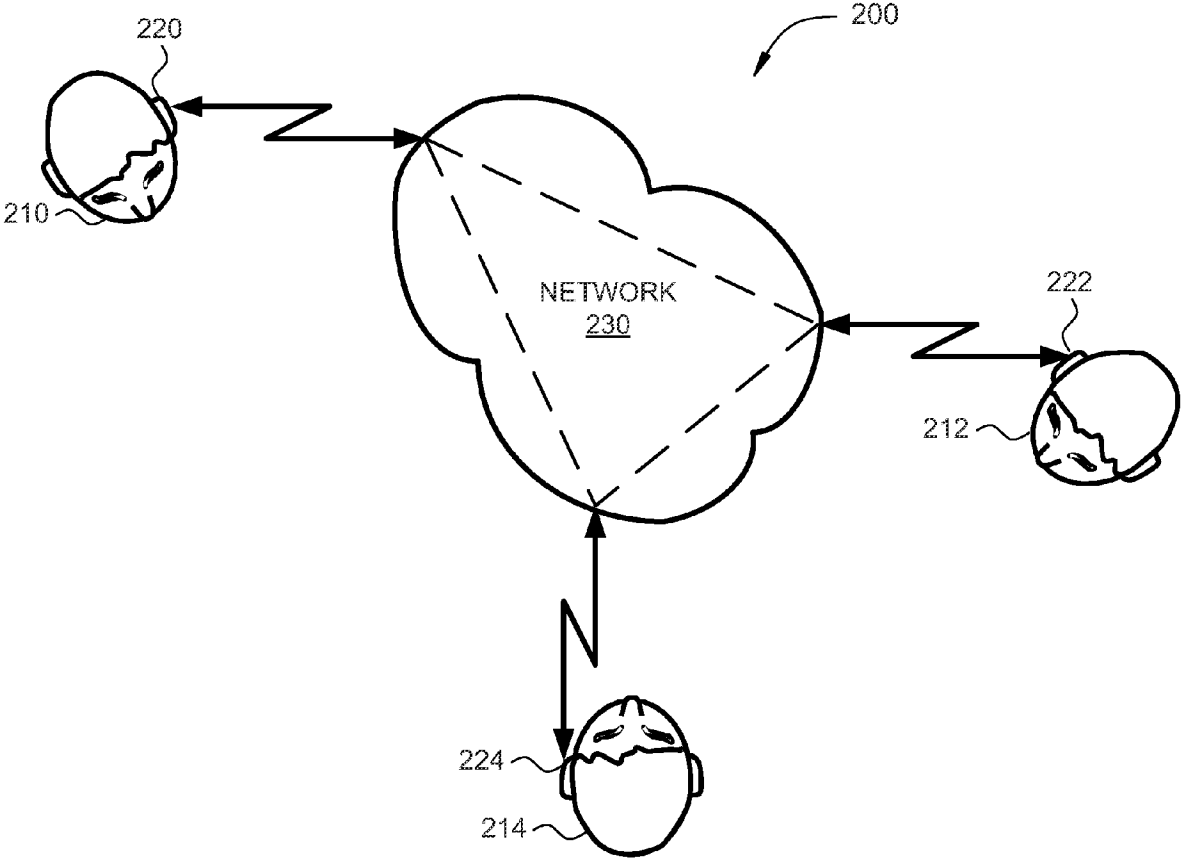
FIG. 2A illustrates a peer-to-peer network of auditory scene controllers for generating auditory scenes, according to various embodiments.

FIG. 2A illustrates a peer-to-peer network 200 of auditory scene controllers 220, 222, and 224 for generating auditory scenes, according to various embodiments. As shown, the peer-to-peer network includes, without limitation, auditory scene controllers 220, 222, and 224 corresponding to users 210, 212, and 214, respectively. Auditory scene controllers 220, 222, and 224 communicate over a network 130.

In this configuration, auditory scene controllers 220, 222, and 224 communicate directly with each other in a peer-to-peer fashion without a central communications controller. Consequently, in response to an action of user 210, such as a button press, auditory scene controller 220 transmits a request to auditory scene controllers 222 and 224 to suppress to voice of user 210. In response, auditory scene controllers 222 and 224 suppress the voice of user 210 so that users 212 and 214 cannot hear user 210. In response to a second action of user 210, such as another button press, auditory scene controller 220 transmits a request to auditory scene controllers 222 and 224 to discontinue suppressing to voice of user 210. In response, auditory scene controllers 222 and 224 discontinue suppressing the voice of user 210 so that users 212 and 214 can again hear user 210.

Figure 2B:
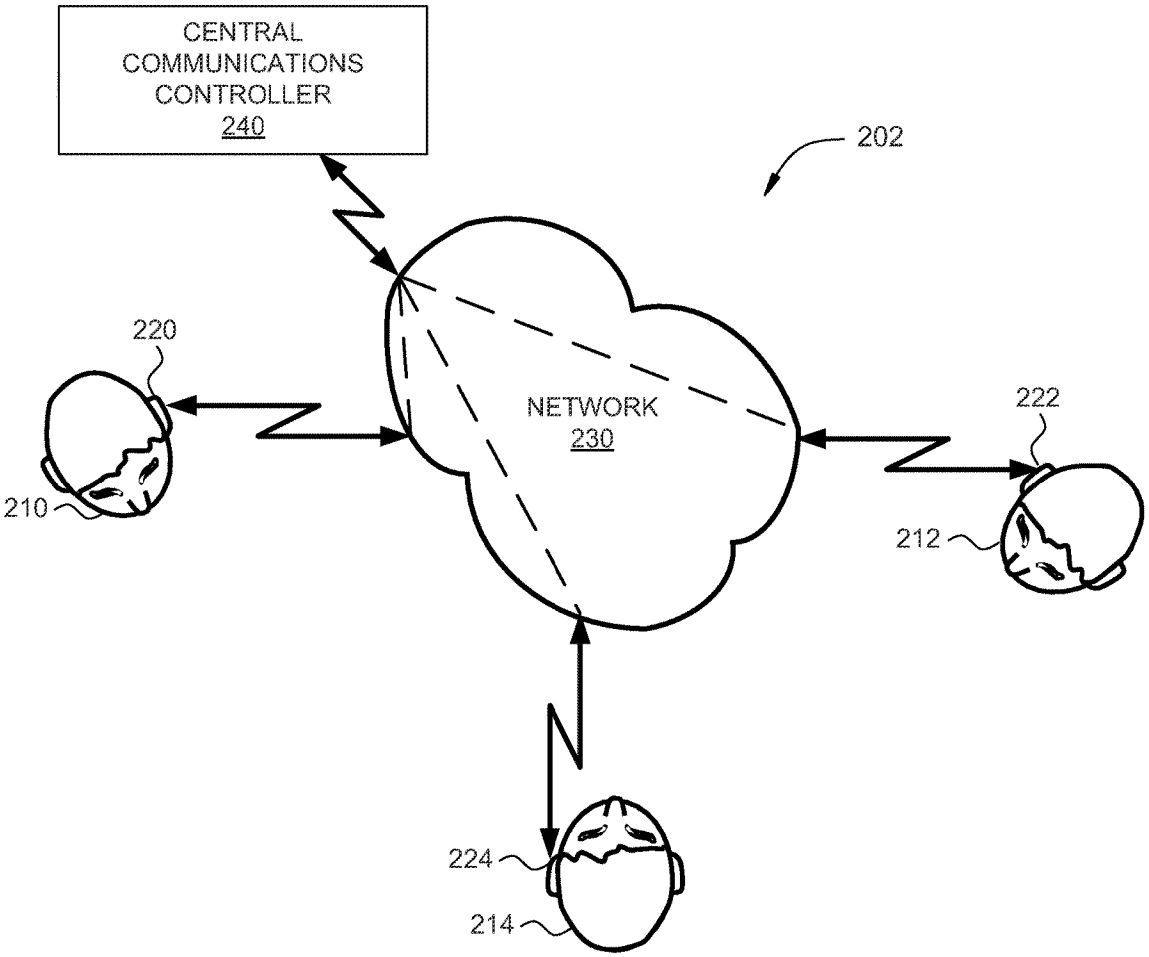
FIG. 2B illustrates a system for generating auditory scenes, according to various embodiments.

FIG. 2B illustrates a system 202 for generating auditory scenes, according to various embodiments. As shown, the system includes, without limitation, a central communications controller 240 and auditory scene controllers 220, 222, and 224 corresponding to users 210, 212, and 214, respectively. Auditory scene controllers 220, 222, and 224 communicate over a network 130. Auditory scene controllers 220, 222, and 224 and network 230 function substantially the same as described in conjunction with FIG. 2A except as further described below.

In this configuration, auditory scene controllers 220, 222, and 224 communicate with each other via central communications controller 240. Central communications controller 240 may be embodied within any technically feasible computing device. Each auditory scene controllers 220, 222, and 224 central communications controller 240. As appropriate, central communications controller 240 forwards communications received from auditory scene controllers 220, 222, and 224 to other auditory scene controllers 220, 222, and 224. In addition, central communications controller 240 may initiate communications directed to auditory scene controllers 220, 222, and 224.

Consequently, in response to an action of user 210, such as a button press, auditory scene controller 220 transmits a request to communication controller 240 to suppress to voice of user 210. In response, communication controller 240 forwards the request to auditory scene controllers 222 and 224. Auditory scene controllers 222 and 224 suppress the voice of user 210 so that users 212 and 214 cannot hear user 210. In response to a second action of user 210, such as another button press, auditory scene controller 220 transmits a request to communication controller 240 to discontinue suppressing the voice of user 210. In response, communication controller 240 forwards the request to auditory scene controllers 222 and 224. Auditory scene controllers 222 and 224 discontinue suppressing the voice of user 210 so that users 212 and 214 can again hear user 210.

Figure 2C:
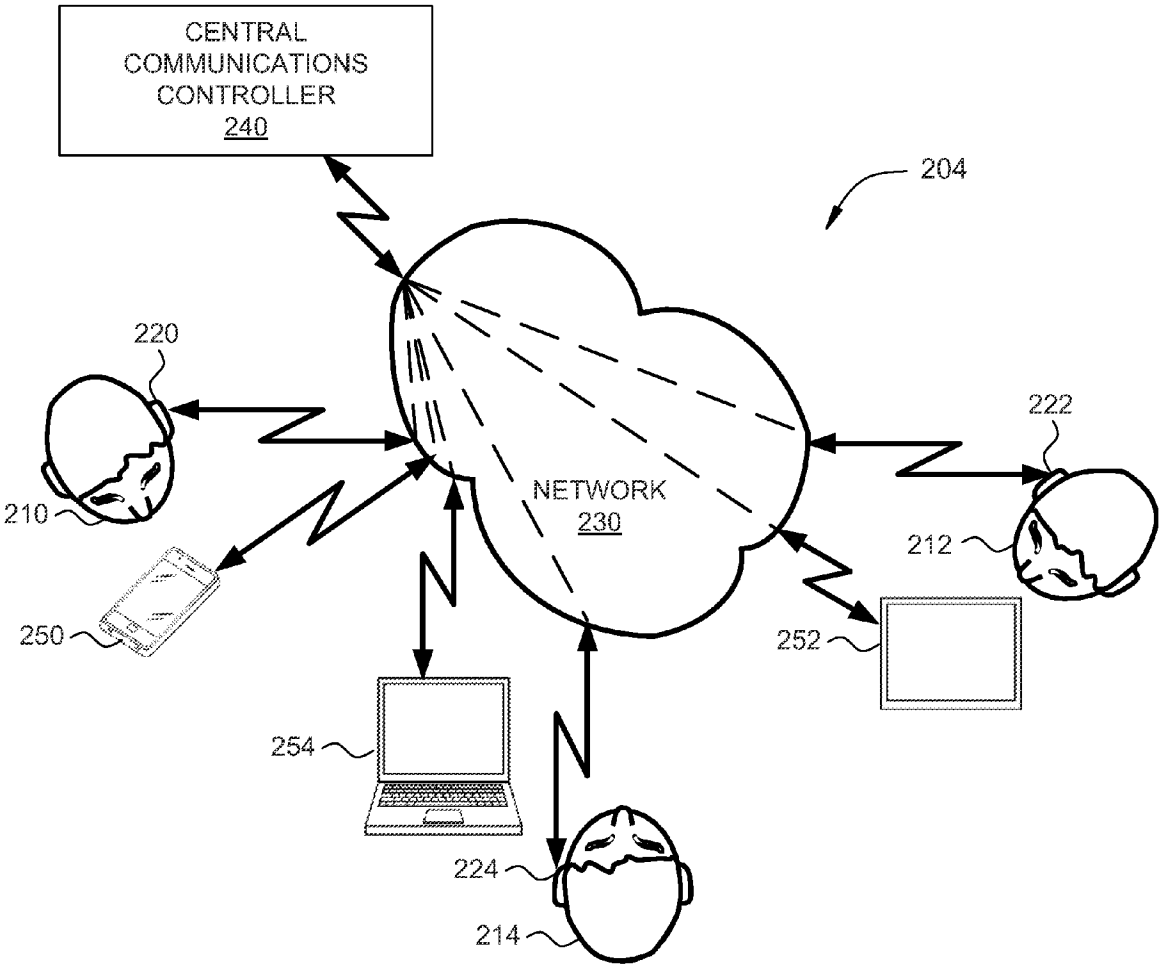
FIG. 2C illustrates a system for generating auditory scenes, according to various embodiments.

FIG. 2C illustrates a system 204 for generating auditory scenes, according to various embodiments. As shown, the system includes, without limitation, a central communications controller 240 and auditory scene controllers 220, 222, and 224 corresponding to users 210, 212, and 214, respectively. As also shown, the system includes user interface devices 250, 252, and 254 corresponding to users 210, 212, and 214, respectively. Auditory scene controllers 220, 222, and 224 communicate over a network 130. Auditory scene controllers 220, 222, and 224, central communications controller 240, and network 230 function substantially the same as described in conjunction with FIG. 2A-B except as further described below.

As shown, user interface device 250 is a smartphone associated with user 210, user interface device 252 is a laptop computer associated with user 210, and user interface device 254 is a tablet computer associated with user 210. Alternatively, various users may be associated with any technically feasible user interface devices, in any combination, including, without limitation, attached to the wearer's glasses, attached to the wearer's necklace or "amulet device," on a wristwatch or a wrist bracelet, embedded into a head band or head ring, attached to an article of clothing or belt buckle, a device attached to or worn anywhere on a user's body, an accessory attached to the user's smartphone or table computer, and attached to a vehicle associated with the user, such as a bicycle or motorcycle.

In the configuration of FIG. 2C, auditory scene controllers 220, 222, and 224 communicate with each other via central communications controller 240. Each auditory scene controllers 220, 222, and 224 central communications controller 240. As appropriate, central communications controller 240 forwards communications received from auditory scene controllers 220, 222, and 224 to other auditory scene controllers 220, 222, and 224. In addition, central communications controller 240 may initiate communications directed to auditory scene controllers 220, 222, and 224. Central communications controller 240 also sends and receives communications between user interface devices 250, 252, and 254. An application executing on user interface devices 250, 252, and 254 may be capable to generate more sophisticated auditory scenes than is possible with the more simple user interface of auditory scene controllers 220, 222, and 224.

Consequently, in response to an action of user 210, such as selecting a function on an application executing on user interface device 250, user interface device 250 transmits a request to communication controller 240 to suppress to voice of user 210. In response, communication controller 240 forwards the request to auditory scene controllers 222 and 224. Auditory scene controllers 222 and 224 suppress the voice of user 210 so that users 212 and 214 cannot hear user 210. In response to a second action of user 210, such as selecting a function on an application executing on user interface device 250, user interface device 250 transmits a request to communication controller 240 to discontinue suppressing the voice of user 210. In response, communication controller 240 forwards the request to auditory scene controllers 222 and 224. Auditory scene controllers 222 and 224 discontinue suppressing the voice of user 210 so that users 212 and 214 can again hear user 210.

Figure 2D:
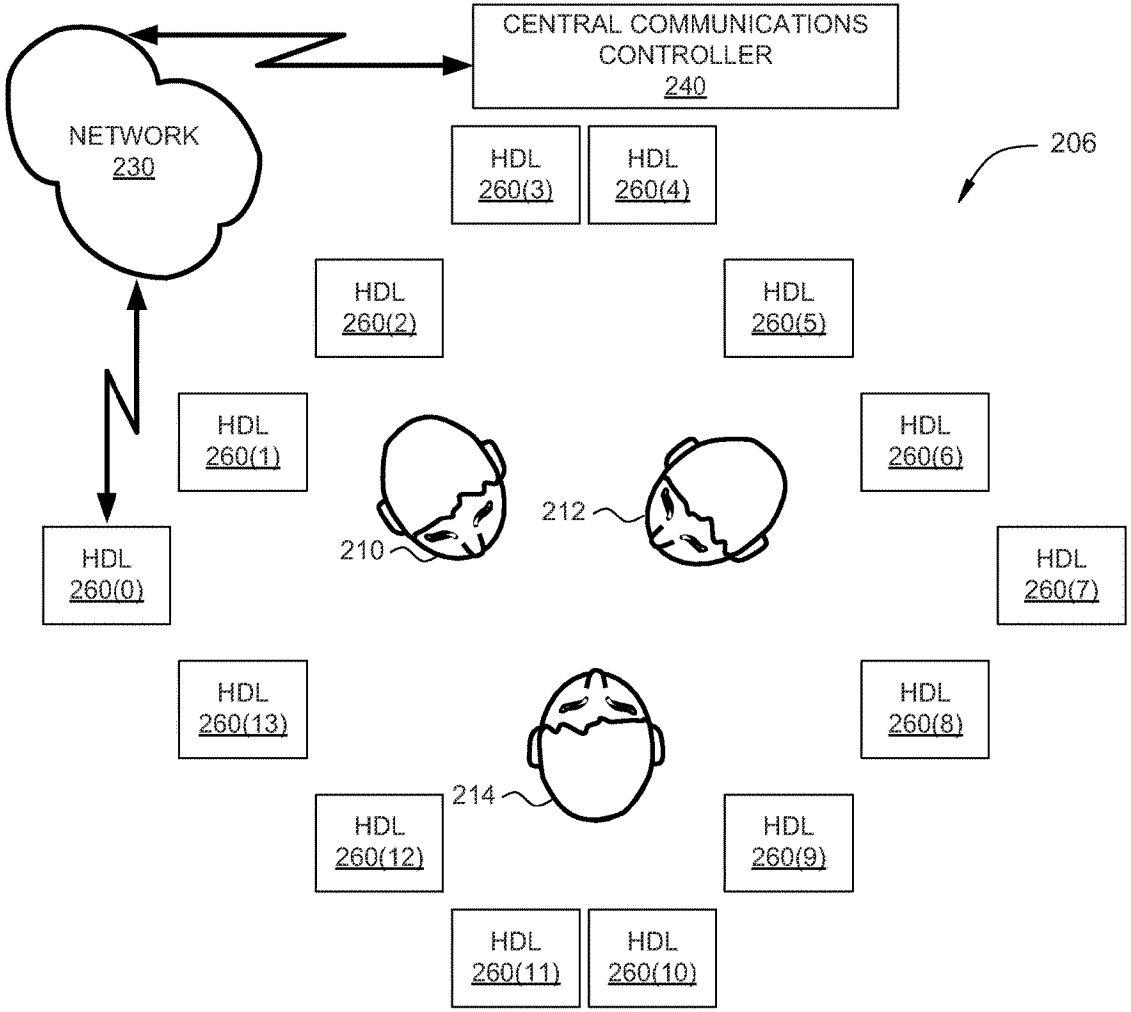
FIG. 2D illustrates a system for generating auditory scenes, according to various embodiments.

FIG. 2D illustrates a system 206 for generating auditory scenes, according to various embodiments. As shown, the system includes, without limitation, a central communications controller 240 and a group of highly directional loudspeakers (HDLs) 260(0)-260(13). Central communications controller 240 communicates with HDLs 260(0)-260(13) over a network 130. Alternatively, central communications controller 240 may directly connect to HDLs 260(0)-260(13). Central communications controller 240 and network 230 function substantially the same as described in conjunction with FIG. 2A-C except as further described below.

HDLs 260 are loudspeakers that generate sound wave patterns with a relatively high degree of directivity (narrowness), rather than the more typical omnidirectional sound wave pattern generated by conventional loudspeakers. Consequently, a given HDL 260 may direct sound at a particular listener, such that the listener hears the sound generated by the HDL 260, but another person sitting just to the left or just to the right of the listener does not hear the sound generated by the HDL 260. For example, and without limitation, HDL 260(1) and HDL 260(2) could be configured to direct sound at the right ear and left ear, respectively, of user 210. HDL 260(5) and HDL 260(6) could be configured to direct sound at the right ear and left ear, respectively, of user 212. HDL 260(10) and HDL 260(11) could be configured to direct sound at the right ear and left ear, respectively, of user 214. Although fourteen HDLs 260(0)-260(13) are shown, any technically feasible quantity of HDLs 260 may be employed, to accommodate any technically feasible quantity of users 210, 212, and 214, within the scope of this disclosure.

The various components of FIGS. 2A-D may be used in any combination, within the scope of the present disclosure. In one example, and without limitation, users may have user interface devices for configuring auditory scenes, as shown in FIG. 2C, and receive audio signals from highly directional loudspeakers, as shown in FIG. 2D. In another example, and without limitation, auditory scene controllers and user interface devices could communicate directly with each other in a peer-to-peer network, as shown in FIG. 2A, without the need for a central communications controller, as shown in FIG. 2C.

As shown, the functionality of auditory scene controller 100 may be incorporated into a wearable device that may be worn or carried by a user. In one embodiment, auditory scene controller 100 may be incorporated into an in-ear device worn by the user. In alternative embodiments, the functionality of auditory scene controller 100 may be incorporated into a head-mounted auditory device that includes at least one of a microphone and a speaker, including, for example and without limitation, a Bluetooth headset, shoulder worn speakers, headphones, ear buds, hearing aids, in-ear monitors, speakers embedded into a headrest, or any other device with having the same effect or functionality. Auditory scene controller 100 may be coupled to a device that includes a user interface for configuring auditory scenes, including, without limitation, a smartphone, a computer, and a tablet computer. Auditory scene controller 100 may be coupled to such a device via any technically feasible approach, including, without limitation, wireless link, a hardwired connection, and a network connection. Wireless links may be made via any technically feasible wireless communication link, including, without limitation, a WiFi™ link, a Bluetooth connection, or a generic radio frequency (RF) connection. In practice, auditory scene controller 100 may establish a communication link with a wide range of different wireless devices beyond those illustrated. The specific devices 250, 252, and 254 illustrated in FIG. 2C are shown for exemplary purposes only and not meant to be limiting.

Exemplary Use-Cases Illustrating the Operation of Auditory Scene Controller

Figure 3:
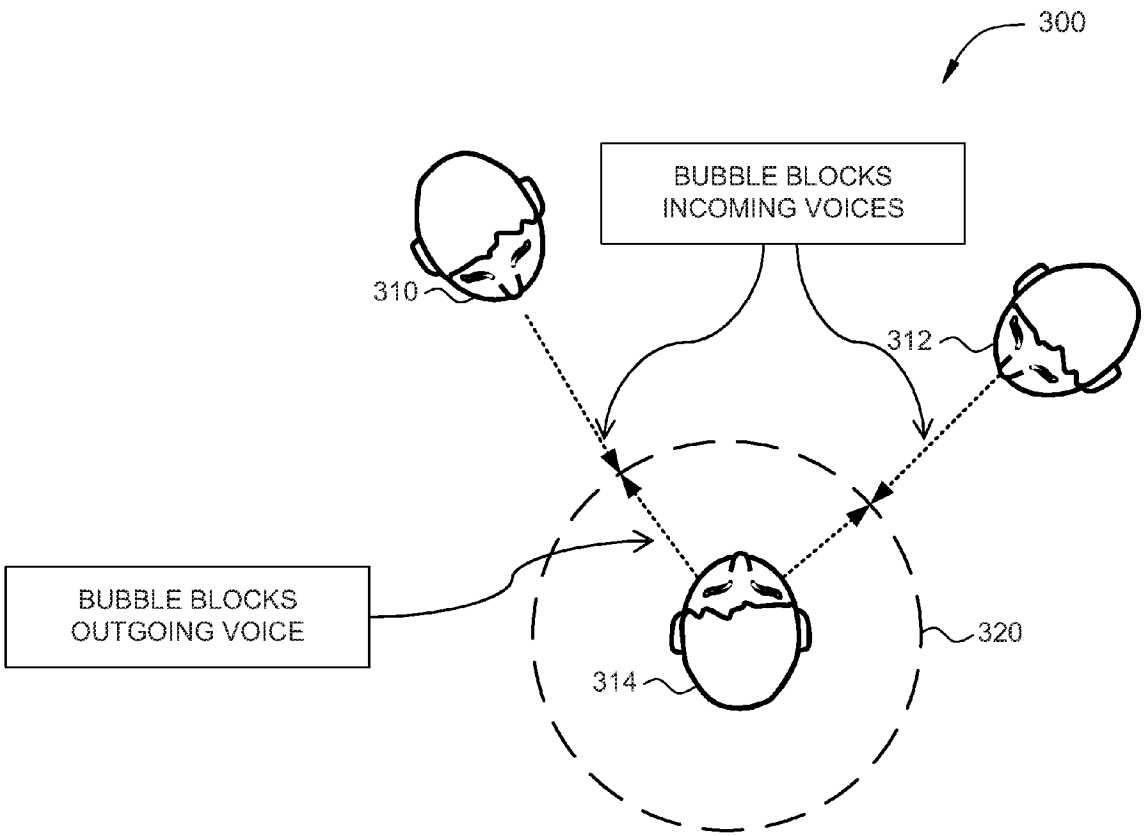
FIG. 3 illustrates an exemplary use case with a bidirectionally isolated auditory scene, according to various embodiments.

FIG. 3 illustrates an exemplary use case 300 with a bidirectionally isolated auditory scene, according to various embodiments. As shown, the use case includes users 310, 312, and 314 and a bidirectionally isolated conversation bubble 320.

In the configuration of FIG. 3, user 314 chooses to be inaudible to users 310 and 312 and to not hear the voices of users 310 and 312. As one example, and without limitation, user 314 would choose this configuration to make a private phone call without distracting, or being distracted by, users 310 and 312. In one example, and without limitation, this configuration could be generated when user 314 wants to place or receive a mobile phone call when in a meeting or riding in a bus or taxicab. In such cases, the auditory scene controller 100 associated with user 314 processes incoming audio signals so as to suppress the voice components of users 310 and 312. The auditory scene controller 100 associated with user 314 sends a request to the auditory scene controllers 100 associated with users 310 and 312 to suppress the voice component of user 314 from their respective input audio signals. A bidirectionally isolated conversation bubble 320 is thereby generated resulting in two auditory scenes, one that includes user 314 and another that includes users 310 and 312.

Figure 4:
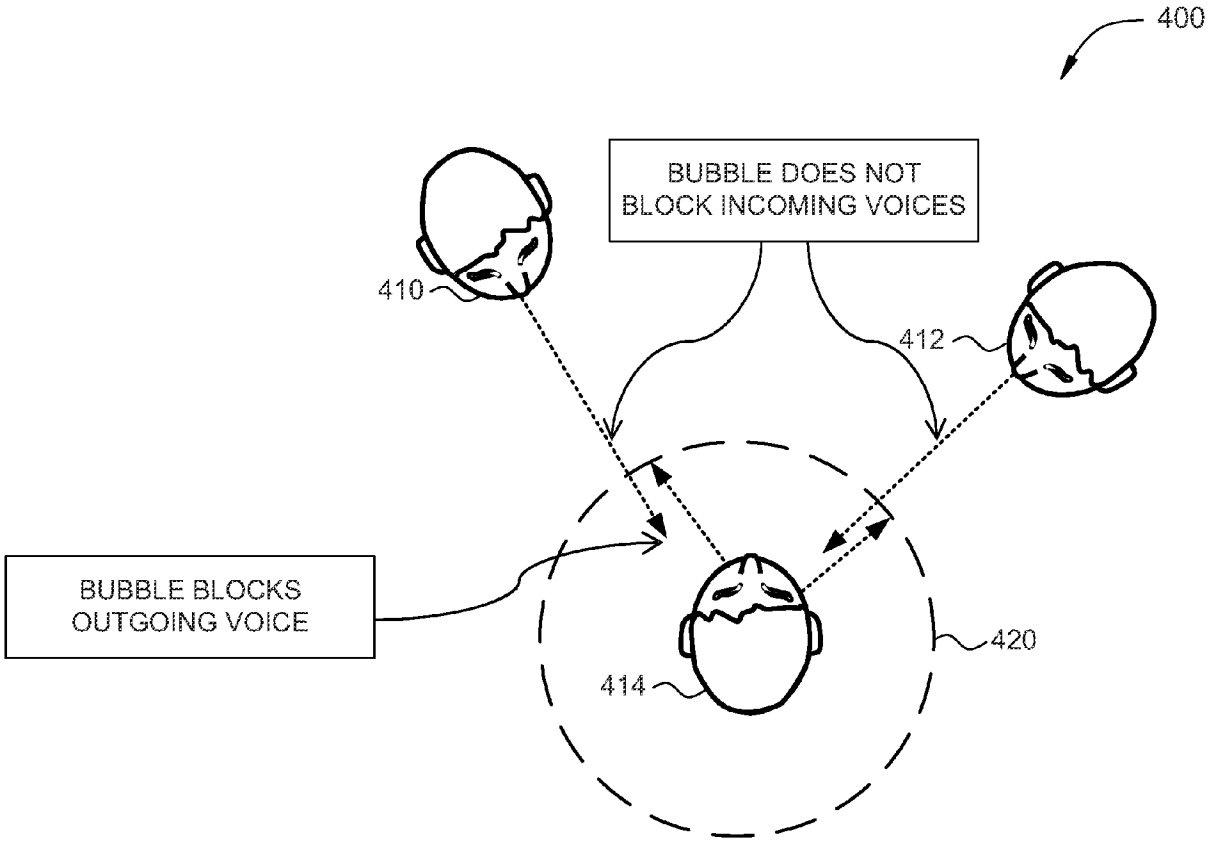
FIG. 4 illustrates an exemplary use case with a unidirectionally outwardly isolated auditory scene, according to various embodiments.

FIG. 4 illustrates an exemplary use case 400 with a unidirectionally outwardly isolated auditory scene, according to various embodiments. As shown, the use case 400 includes users 410, 412, and 414 and a unidirectionally outwardly isolated conversation bubble 420.

In the configuration of FIG. 4, user 414 chooses to be inaudible to users 410 and 412, but chooses to hear the voices of users 410 and 412. In one example, and without limitation, user 414 would choose this configuration to make a private phone call without distracting users 410 and 412, but would still like to hear the conversation taking place between users 410 and 412, such as when user 410 is in a meeting or riding in a bus or taxicab. In such cases, the auditory scene controller 100 associated with user 414 sends a request to the auditory scene controllers 100 associated with users 410 and 412 to suppress the voice component of user 414 from their respective input audio signals. The auditory scene controller 100 associated with user 414 processes incoming audio signals so as to pass the voice components of users 410 and 412 at either full volume or reduced volume, depending on the preference of user 414. A unidirectionally outwardly isolated conversation bubble 420 is thereby generated resulting in two auditory scenes, one that includes user 414 and another that includes users 410 and 412.

Figure 5:
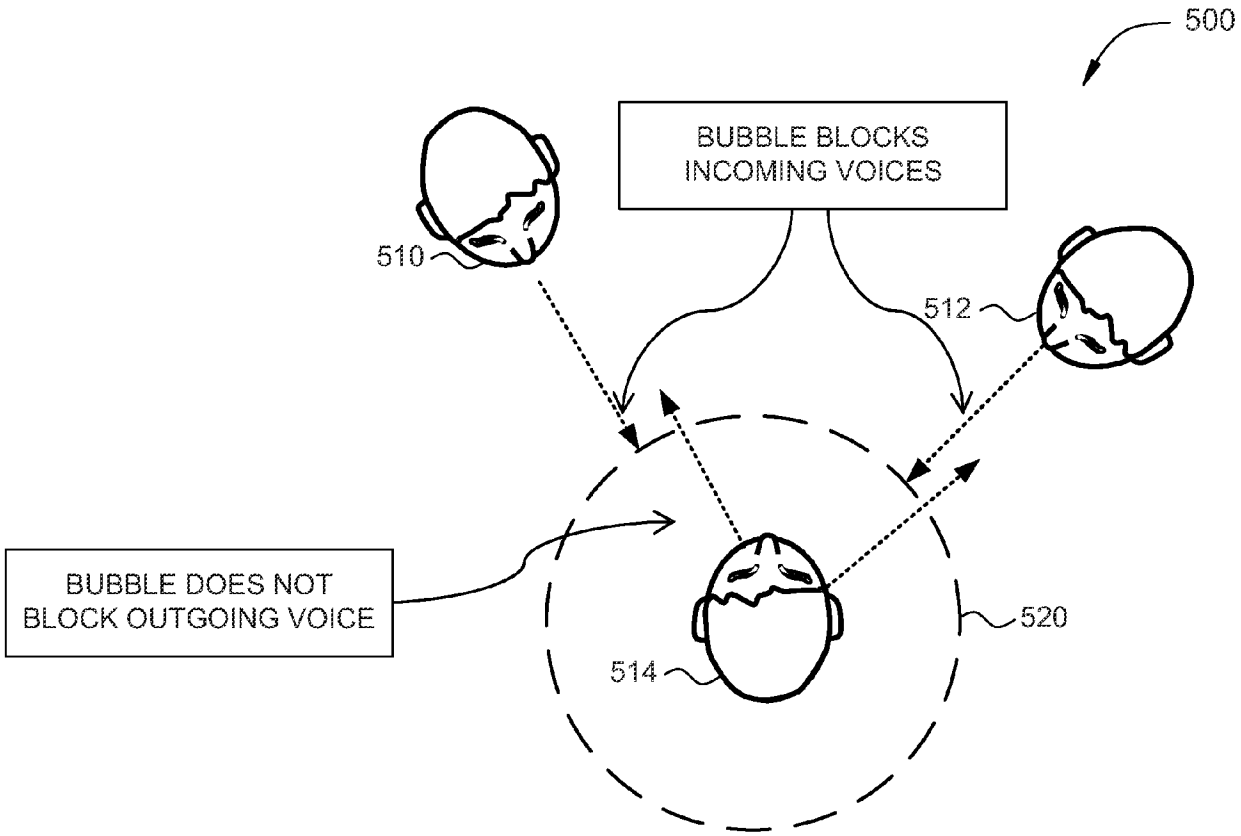
FIG. 5 illustrates an exemplary use case with a unidirectionally inwardly isolated auditory scene, according to various embodiments.

FIG. 5 illustrates an exemplary use case 500 with a unidirectionally inwardly isolated auditory scene, according to various embodiments. As shown, the use case 500 includes users 510, 512, and 514 and a unidirectionally inwardly isolated conversation bubble 520.

In the configuration of FIG. 5, user 514 chooses to be audible to users 510 and 512, but chooses to not to hear the voices of users 510 and 512. In one example, and without limitation, user 514 would choose this configuration to eliminate distractions from the conversation between users 510 and 512 but would like to interject comments that users 510 and 512 would be able to hear. In another example, and without limitation, user 514 would choose this configuration to focus on replying to email or attending to other matters temporarily without distraction and does not want to leave the location where users 510 and 512 are holding a conversation. In such cases, the auditory scene controller 100 associated with user 514 sends a request to the auditory scene controllers 100 associated with users 510 and 512 to pass the voice component of user 514 with their respective input audio signals. The auditory scene controller 100 associated with user 514 processes incoming audio signals so as to suppress the voice components of users 510 and 512 at either full volume or reduced volume, depending on the preference of user 514. A unidirectionally inwardly isolated conversation bubble 520 is thereby generated resulting in two auditory scenes, one that includes user 514 and another that includes users 510 and 512.

Figure 6:
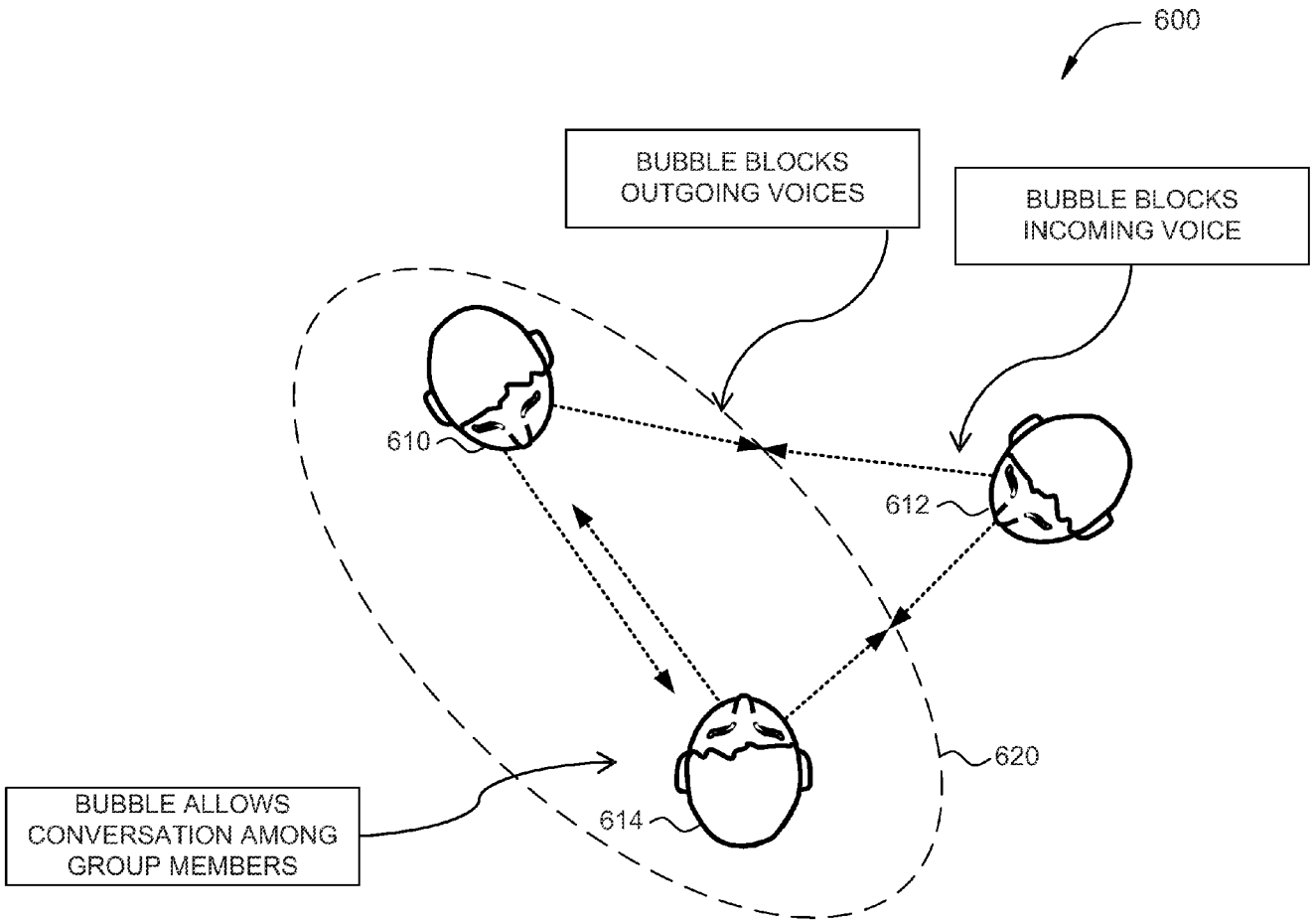
FIG. 6 illustrates an exemplary use case with a bidirectionally isolated auditory scene of multiple users, according to various embodiments.

FIG. 6 illustrates an exemplary use case 600 with a bidirectionally isolated auditory scene of multiple users, according to various embodiments. As shown, the use case 600 includes users 610, 612, and 614 and a bidirectionally isolated conversation bubble with multiple users 620.

In the configuration of FIG. 6, users 610 and 614 choose to be inaudible to user 612 and to not hear the voice of user 612. In one example, and without limitation, users 610 and 614 would choose this configuration to hold a private conversation outside of the hearing of user 612. Users 610 and 614 could choose this configuration to hold a private conversation in a library or a coffee shop without distracting user 612. In such cases, one or both of the auditory scene controllers 100 associated with users 610 and 614 send a request to the auditory scene controller 100 associated with user 612 to suppress the voice component of users 610 and 614 with the input audio signal. The auditory scene controllers 100 associated with users 610 and 614 process incoming audio signals so as to fully or partially suppress the voice component of user 612 at either full volume or reduced volume, depending on the preference of user 614. The auditory scene controllers 100 associated with users 610 and 614 could optionally choose to suppress background noise, such as when users 610 and 614 are holding a conversation in a noisy environment. A bidirectionally isolated conversation bubble with multiple users 620 is thereby generated resulting in two auditory scenes, one that includes user 612 and another that includes users 610 and 614.

Figure 7:
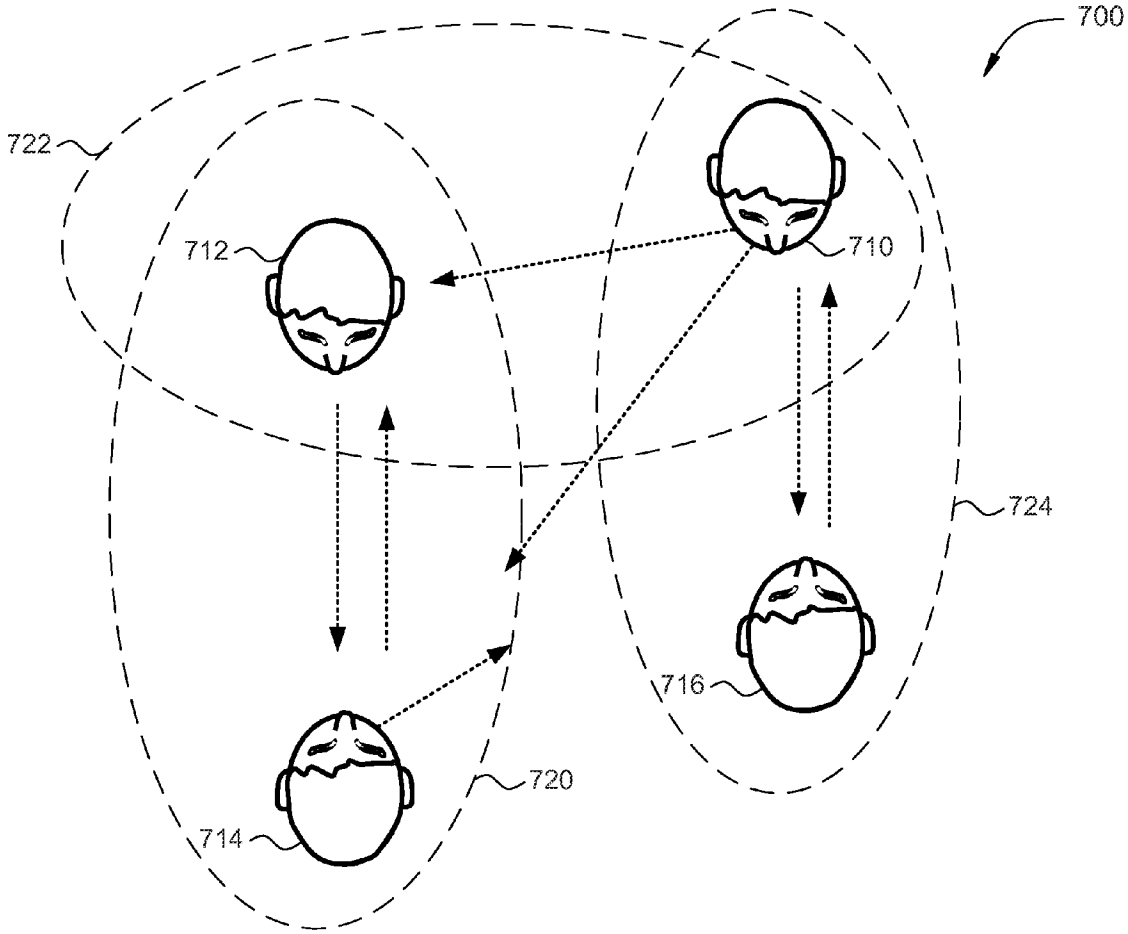
FIG. 7 illustrates an exemplary use case with a multidirectionally isolated auditory scene of multiple users, according to various embodiments.

FIG. 7 illustrates an exemplary use case 700 with a multidirectionally isolated auditory scene of multiple users, according to various embodiments. As shown, the use case includes users 710, 712, 714, and 716 and multidirectionally isolated conversation bubble 720, 722, and 724.

In the configuration of FIG. 7, users 710 and 716 would like to converse with each other, while users 712 and 714 would like to converse with each other. In addition, user 712 would like to hear the voice of user 710. As one example, and without limitation, users 710, 712, 714, and 716 for situations where user 710 is giving a speech in one language, while user 712 is translating the speech into a second language. User 716 hears the speech in the language spoken by 710, but does not hear the voices of users 712 or 714. User 714 hears the voice of user 712, but the voice of user 710 is fully or partially suppressed for user 714 at user 714's preference. In such cases, the auditory scene controllers 100 associated with users 710, 712, 714, and 716 send requests to the each other to suppress the appropriate voice components. The auditory scene controllers 100 associated with users 710, 712, 714, and 716 process incoming audio signals so as to fully or partially suppress the voice component of various users at either full volume or reduced volume, as appropriate. Multidirectionally isolated conversation bubbles 720, 722, and 724 are thereby generated resulting in three auditory scenes, one that includes users 710 and 716, another that includes users 710 and 712, and another that includes users 712 and 714.

Persons skilled in the art will understand that the exemplary use-case scenarios described above in conjunction with FIGS. 3-7 are provided for exemplary purposes only to illustrate different techniques auditory scene controller 100 may implement to generate various auditory scene configurations. Many other configurations of any quantity of auditory scenes, each auditory scene including any quantity of users, may be implemented using the described techniques, within the scope of this disclosure. Further, the examples discussed above, although presented with reference to specific commands, devices, and operations, are not meant to limit the scope of the invention to those specificities.

Having described various use cases and systems for generating various configurations of auditory scenes, exemplary algorithms that may be implemented by auditory scene controller 100 are now described. By implementing the functionality described thus far, auditory scene controller 100 may improve the ability of individuals to simultaneously conduct various conversations in the same space without interfering with each other.

Exemplary Algorithms Implemented by Auditory Scene Controller

Figure 8:
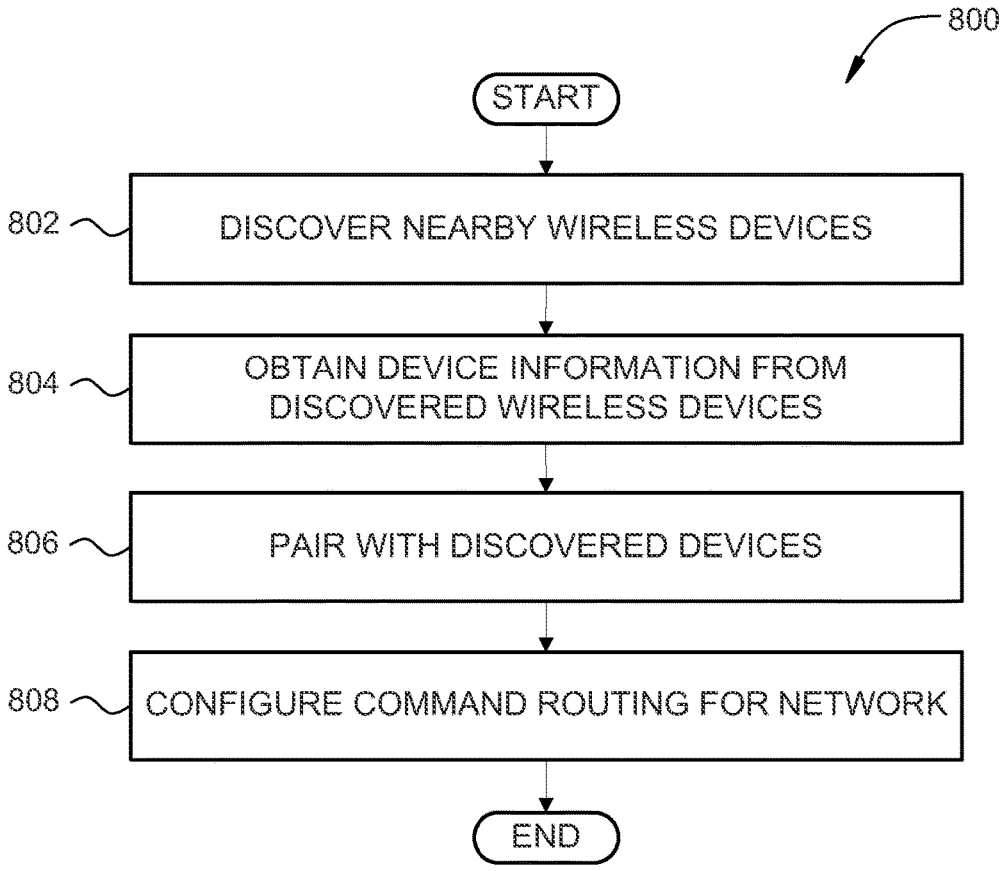
FIG. 8 is a flow diagram of method steps for initializing and configuring an auditory scene controller to communicate with other auditory scene controllers, according to various embodiments.

FIG. 8 is a flow diagram of method steps for initializing and configuring an auditory scene controller to communicate with other auditory scene controllers, according to various embodiments. Although the method steps are described in conjunction with the systems of FIGS. 1-7, persons skilled in the art will understand that any system configured to perform the method steps, in any order, is within the scope of the present invention.

As shown, a method 800 begins at step 802, where auditory scene controller 100 discovers nearby wireless devices, including, without limitation, other auditory scene controllers and a central communications controller. Auditory scene controller 100 may perform any technically feasible form of device discovery, including, and without limitation, locating a WiFi™ access point and then identifying other devices coupled thereto, interacting directly with nearby Bluetooth devices, or performing generic handshaking with wireless devices using RF signals.

At step 804, auditory scene controller 100 obtains device information from each discovered device that reflects, among other things, device capabilities. The capabilities could include, for example, and without limitation, a preferred wireless connection protocol (e.g., WiFi™, Bluetooth, without limitation), a maximum quantity of auditory scenes supported by the device, and so forth. Other device information could include, for example, and without limitation, a device position, a device battery level, etc.

At step 806, auditory scene controller 100 pairs with one or more of the discovered devices. In doing so, auditory scene controller 100 may rely on any relevant protocol. In addition, auditory scene controller 100 may pair with different devices that rely on different protocols.

Figure 9:
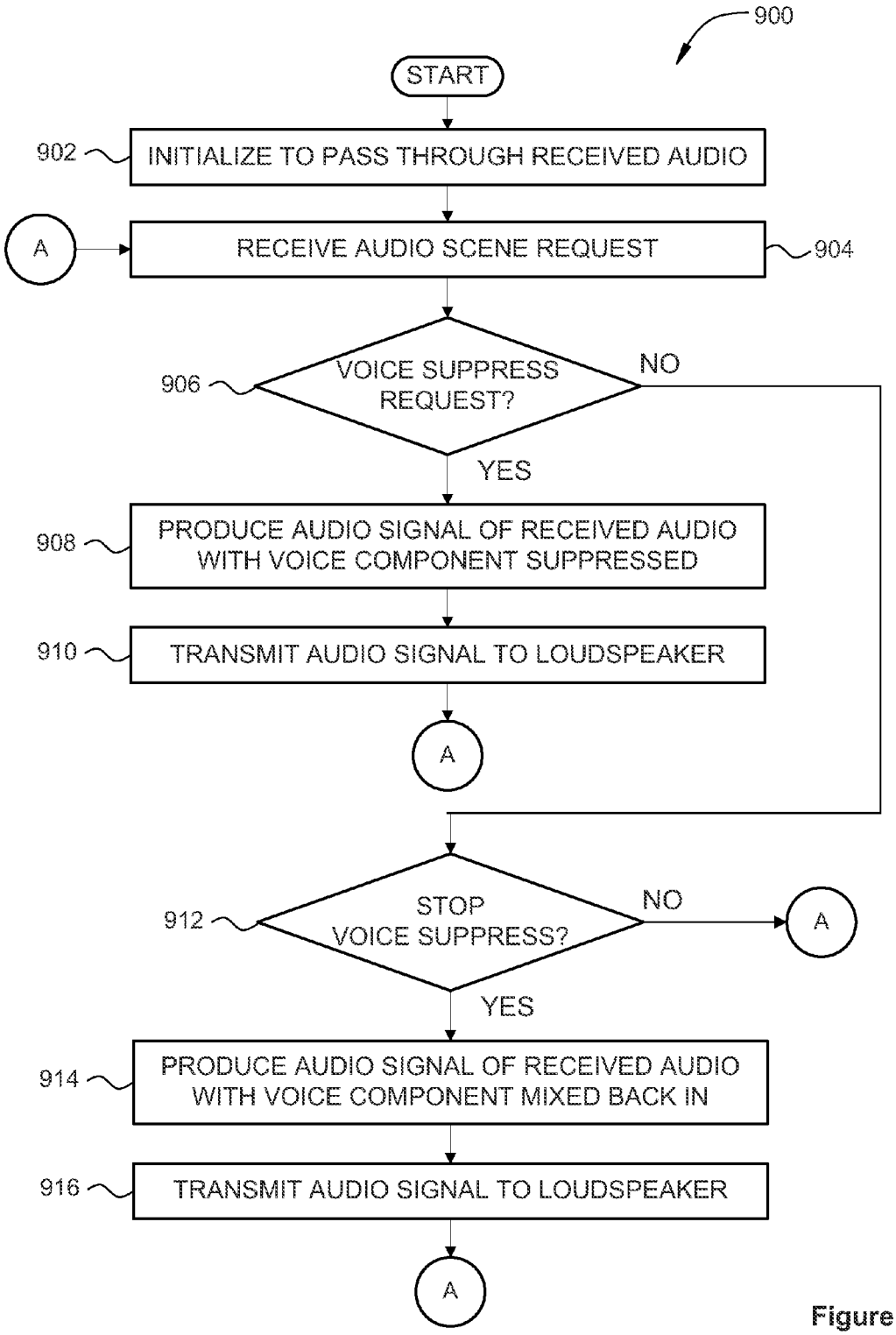
FIG. 9 is a flow diagram of method steps for generating an auditory scene via an auditory scene controller, according to various embodiments.

At step 808, auditory scene controller 100 configures command routing preferences for paired devices, as needed. In doing so, auditory scene controller 100 may communicate directly with other auditory scene controllers in a peer-to-peer network. Alternatively, auditory scene controller 100, along with other auditory scene controllers, communicates directly with only central communications controller 240, and central communications controller communicates with each of the auditory scene controllers separately. FIG. 9, discussed below, describes the normal operation of auditory scene controller 100 in stepwise fashion.

FIG. 9 is a flow diagram of method steps for generating an auditory scene via an auditory scene controller, according to various embodiments. Although the method steps are described in conjunction with the systems of FIGS. 1-7, persons skilled in the art will understand that any system configured to perform the method steps, in any order, is within the scope of the present invention.

As shown, a method 900 begins at step 902, where auditory scene controller 100 initializes to a state where the audio input signal received from microphone module 110 is transmitted to speaker module 140 without alteration. At step 904, the auditory scene controller 100 receives an audio scene request, for example, and without limitation, by receiving a request from another auditory scene controller or from central communications controller 240.

At step 906, auditory scene controller 100 determines whether the audio scene request was a request to suppress an audio voice component, such as a voice associated with another auditory scene controller. If the audio scene request is a voice suppress request, then the method 900 proceeds to step 908, where auditory scene controller 100 generates an audio signal that includes the received audio input signal with the requested voice component suppressed. At step 910, auditory scene controller 100 transmits the generated audio signal to loudspeaker module 140. The method 900 then process to step 904, described above.

If, at step 906, the audio scene request is not a voice suppress request, then the method 900 proceeds to step 912, where auditory scene controller 100 determines whether the audio scene request was a request to discontinue suppressing an audio voice component, such as a voice associated with another auditory scene controller. If the audio scene request is a stop voice suppress request, then the method 900 proceeds to step 914, where auditory scene controller 100 generates an audio signal that includes the received audio input signal and with requested voice component mixed back into the signal. At step 916, auditory scene controller 100 transmits the generated audio signal to loudspeaker module 140. The method 900 then process to step 904, described above.

If, at step 906, the audio scene request is not a stop voice suppress request, then the method 900 proceeds to step 904, described above.

In sum, an auditory scene controller is configured to generate multiple auditory scenes in a physical environment. The auditory scene controller can bidirectionally isolate a user of the auditory signal by suppressing all voices in the incoming audio signal and sending a request to other auditory scene controller to suppress the user's voice to disallow the user's voice to be heard by other users. Alternatively, the auditory scene controller can unidirectionally isolate a user of the auditory signal by suppressing all voices in the incoming audio signal, but allowing the user's voice to be heard by other users. Alternatively, the auditory scene controller can unidirectionally isolate a user of the auditory signal by allowing all voices in the incoming audio signal to be heard by the user, but sending a request to other auditory scene controller to suppress the user's voice to disallow the user's voice to be heard by other users. Conversational bubbles may be generated to allow a subgroup of several people to converse with each other in the subgroup, but be isolated from the conversation of other users in the main group.

At least one advantage of the approach described herein is that participants in a group may engage in multiple conversations while maintaining appropriate privacy for each conversation and reducing or eliminating disruption to other conversations. As a result, important conversations are not deferred and multiple conversations are accommodated without the need to find separate physical space to accommodate each separate conversation.

One embodiment of the invention may be implemented as a program product for use with a computer system. The program(s) of the program product define functions of the embodiments (including the methods described herein) and can be contained on a variety of computer-readable storage media. Illustrative computer-readable storage media include, but are not limited to: (i) non-writable storage media (e.g., read-only memory devices within a computer such as compact disc read only memory (CD-ROM) disks readable by a CD-ROM drive, flash memory, read only memory (ROM) chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored.

The invention has been described above with reference to specific embodiments. Persons of ordinary skill in the art, however, will understand that various modifications and changes may be made thereto without departing from the broader spirit and scope of the invention as set forth in the appended claims. The foregoing description and drawings are, accordingly, to be regarded in an illustrative rather than a restrictive sense.

Therefore, the scope of embodiments of the present invention is set forth in the claims that follow.

What is claimed is:

1. A computer-implemented method for generating auditory scenes, the method comprising:

receiving, via a first auditory scene controller, a first signal that represents a first voice component included in a first plurality of voice components within a physical environment, wherein the first auditory scene controller captures, via a first microphone and from the physical environment, a real-time voice that corresponds to the first voice component to generate the first signal;

receiving, via the first auditory scene controller, timing information indicating a time interval during which the first voice components corresponding to the real-time voice are to be suppressed;

receiving a request to at least partially suppress the first voice component;

capturing, via a second microphone embedded in an in-ear auditory device, the first plurality of voice components from the physical environment to generate a first auditory signal, wherein the in-ear auditory device captures, via the second microphone and from the physical environment, the same real-time voice that corresponds to the first voice component to generate the first auditory signal;

generating, based on the first signal, the timing information, and the first auditory signal, a second auditory signal that includes the first plurality of voice components with the first voice component at least partially suppressed relative to other voice components included in the first plurality of voice components; and transmitting the second auditory signal to a speaker embedded in the in-ear auditory device for output.

2. The computer-implemented method of claim 1, further comprising transmitting a second request to a second auditory scene controller to suppress the first voice component.

3. The computer-implemented method of claim 1, further comprising:

receiving a request to discontinue suppressing the first voice component;

generating a third auditory signal that includes the first plurality of voice components with the first voice component unsuppressed; and transmitting the third auditory signal to the speaker for output.

4. The computer-implemented method of claim 1, wherein the second auditory signal includes the first plurality of voice components with the first voice component fully suppressed relative to the other voice components included in the first plurality of voice components.

5. The computer-implemented method of claim 1, further comprising receiving a request to suppress a second voice component included in the first plurality of voice components, wherein generating the second auditory signal comprises partially suppressing the second voice component included in the first auditory signal.

6. The computer-implemented method of claim 1, wherein generating the second auditory signal further comprises suppressing a background noise signal received by the microphone.

7. The computer-implemented method of claim 1, wherein generating the second auditory signal comprises generating an inversion signal that corresponds to the first voice component.

8. The computer-implemented method of claim 1, wherein the in-ear auditory device is worn by a first user, the first audio scene controller is operated by a second user, and the first voice component corresponds to a voice of the second user.

9. The computer-implemented method of claim 8, further comprising:

receiving, via the first auditory scene controller and by a second in-ear auditory device worn by a third user, a second signal that represents the first voice component;

receiving, by the second in-ear auditory device, a second request to at least partially suppress the first voice component;

receiving, from a third microphone embedded in the second in-ear auditory device, a third auditory signal that includes the first plurality of voice components;

generating, based on the second signal and the third auditory signal, a fourth auditory signal that includes the first plurality of voice components with the first voice component at least partially suppressed relative to other voice components included in the first plurality of voice components; and transmitting the fourth auditory signal to a speaker embedded in the second in-ear auditory device for output.

10. A computing device, comprising:

a wireless network interface; and a processor configured to:

receive, via a first auditory scene controller, a first signal that represents a first voice component included in a first plurality of voice components within a physical environment, wherein the first auditory scene controller captures, via a first microphone and from the physical environment, a real-time voice that corresponds to the first voice component to generate the first signal;

receive, via the first auditory scene controller, timing information indicating a time interval during which the first voice components corresponding to the real-time voice are to be suppressed;

receive a request to at least partially suppress the first voice component;

capture, via a second microphone embedded in an in-ear auditory device, the first plurality of voice components from the physical environment to generate a first auditory signal, wherein the in-ear auditory device captures, via the second microphone and from the physical environment, the same real-time voice that corresponds to the first voice component to generate the first auditory signal;

generate, based on the first signal, the timing information, and the first auditory signal, a second auditory signal that includes the first plurality of voice components with the first voice component at least partially suppressed relative to other voice components included in the first plurality of voice components; and transmit the second auditory signal to a speaker embedded in the in-ear auditory device for output.

11. The computing device of claim 10, wherein the request to suppress the first voice component is received via the wireless network interface.

12. The computing device of claim 10, further comprising an input device, wherein the request to suppress the first voice component is received via actuation of the input device.

13. The computing device of claim 10, wherein the processing unit is further configured to transmit, via the wireless network interface, a request directed to a second auditory scene controller to suppress the first voice component, wherein the second auditory scene controller is configured to generate a third auditory signal that includes the first plurality of voice components with the first voice component at least partially suppressed.

14. The computing device of claim 10, wherein the processing unit is further configured to transmit, via the wireless network interface, a request directed to a second auditory scene controller to at least partially suppress all voice components except for a voice component associated with the computing device.

15. The computing device of claim 14, wherein the processing unit is further configured to receive, via the wireless network interface, a request to suppress all voice components except for a voice component associated with the first auditory scene controller.

16. The computing device of claim 14, wherein the processing unit is further configured to receive, via the wireless network interface, a request to suppress all voice components except for voice components associated with the first auditory scene controller and a second auditory scene controller.

17. The computing device of claim 16, wherein the first auditory scene controller is configured to partially suppress the voice component associated with the second auditory scene controller and fully suppress all other voice components except for the voice component associated with the computing device.

18. A non-transitory computer-readable medium storing program instructions that, when executed by a processing unit, cause the processing unit to generate an auditory scene, by performing the steps of:

receiving, via a first auditory scene controller, a first signal that represents a first voice component included in a first plurality of voice components within a physical environment, wherein the first auditory scene controller captures, via a first microphone and from the physical environment, a real-time voice that corresponds to the first voice component to generate the first signal;

receiving, via the first auditory scene controller, timing information indicating a time interval during which the first voice components corresponding to the real-time voice are to be suppressed;

receiving a request to at least partially suppress the first voice component;

capturing, via a second microphone embedded in an in-ear auditory device, the first plurality of voice components from the physical environment to generate a first auditory signal, wherein the in-ear auditory device captures, via the second microphone and from the physical environment, the same real-time voice that corresponds to the first voice component to generate the first auditory signal;

generating, based on the first signal, the timing information, and the first auditory signal, a second auditory signal that includes the first plurality of voice components with the first voice component suppressed relative to other voice components included in the first plurality of voice components; and transmitting the second auditory signal to a speaker embedded in the in-ear auditory device for output.

19. The non-transitory computer-readable medium of claim 18, further comprising the step of transmitting a request to a second auditory scene controller to suppress the first voice component.

* * * * *